United States Patent [19]

Tift et al.

[11] 4,072,335

[45] Feb. 7, 1978

[54] LIFTING DEVICE

[76] Inventors: Arlan William Tift, 3310 Panorama Drive, Redding, Calif. 96001; Delbert W. Strait, 5334 Pine St., Anderson, Calif. 96007

[21] Appl. No.: 775,105

[22] Filed: Mar. 7, 1977

[51] Int. Cl.[2] ..... B66F 13/00

[52] U.S. Cl. ..... 294/93; 254/131

[58] Field of Search ..... 254/131; 269/47, 49; 294/12, 93

[56] References Cited

FOREIGN PATENT DOCUMENTS

| | | | |
|---|---|---|---|
| 760,844 | 6/1967 | Canada | 269/47 |
| 1,438,529 | 4/1965 | France | 254/131 |
| 1,096,297 | 12/1960 | Germany | 269/47 |
| 603,890 | 6/1948 | United Kingdom | 269/49 |

*Primary Examiner*—Robert C. Watson

*Attorney, Agent, or Firm*—Herbert C. Schulze

[57] ABSTRACT

A lifting tool for lifting water meter covers including a hook member contoured and sized to go through the hole in the water meter cover and a telescoping sleeve member around the shank of the hook member, adapted to move up and down relative to the hook member, and including a spacing member for forcing the hook at the end of the hook member to engage the bottom of the water meter cover to facilitate lifting of the cover.

3 Claims, 5 Drawing Figures

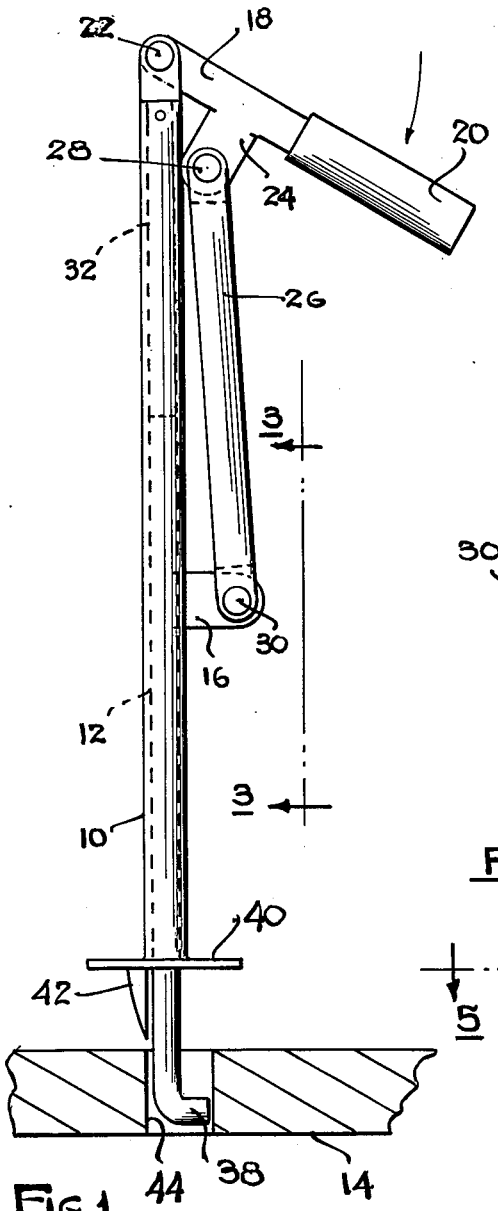
FIG. 1
FIG. 3
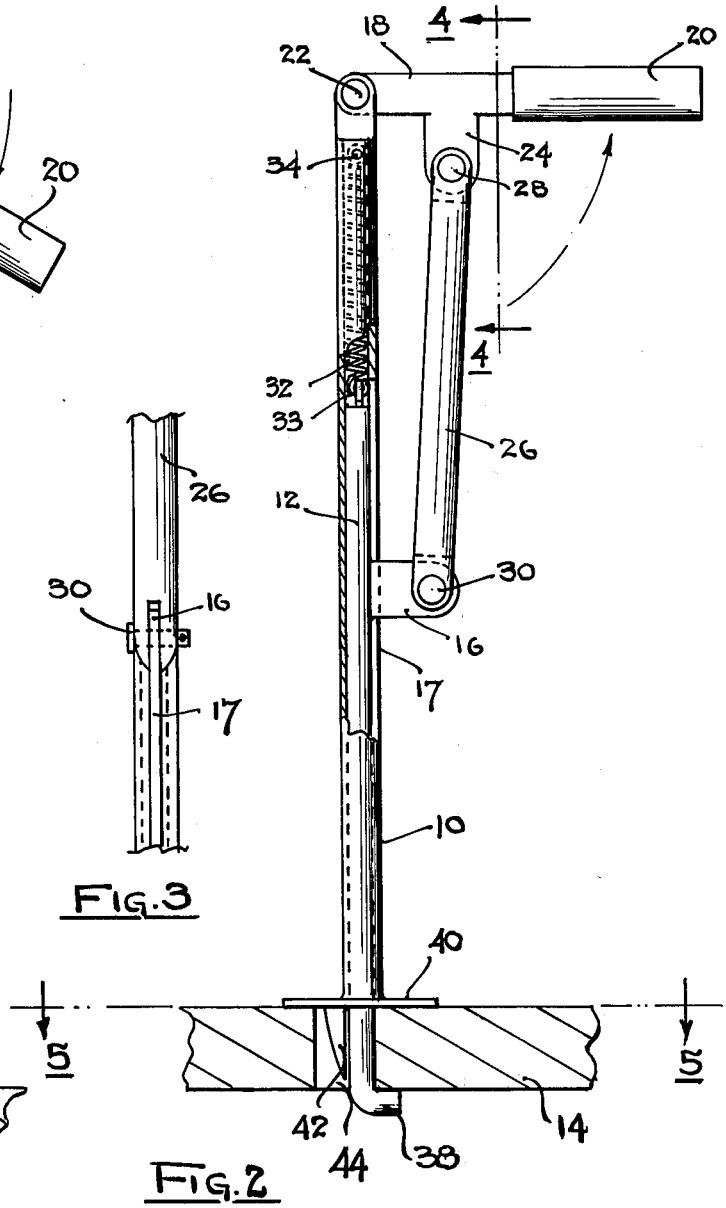
FIG. 2
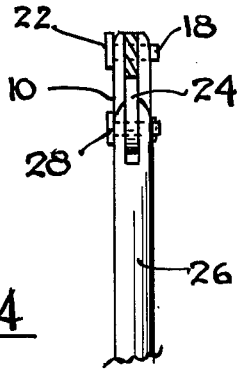
FIG. 4
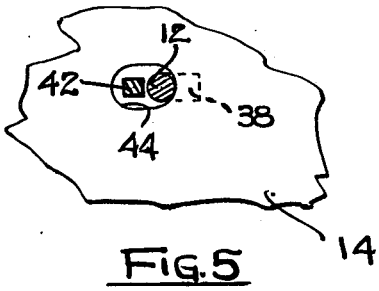
FIG. 5

LIFTING DEVICE

BACKGROUND OF THE INVENTION

Typically water meters in residential districts are enclosed in concrete boxes which have a top made of concrete and are adapted to fit into the top of a water meter box, closing the top. Water meter covers are typically two feet long by about one foot wide by two inches thick, and they have a hole therein through which a hook may be inserted to engage the lid so that it may be dragged off of the top of the meter box and allow the water meter to be read.

Usually the lid is either removed by the reader placing a bar or screw driver between the lid and the box to pry up the lid or by a hook which is inserted into the hole and used to drag the meter lid off of the meter box.

BRIEF DESCRIPTION OF THE INVENTION

The apparatus of this invention is a novel lifting member for lifting the covers of water meter boxes.

The covers of water meter boxes customarily have a substantially rectangular hole therein to enable the cover to be grasped to remove it from the meter box.

The apparatus of this invention has a rod member which, in use, is substantially upstanding and which has a hook on the end thereof. The hook is short enough that it may be inserted through the opening in the water meter cover to engage the under side of the water meter cover. Surrounding the upstanding rod member is a sleeve member. The sleeve member has a slot therein along a portion of the length thereof through which a tab connected to the rod member protrudes. This allows the rod member to be held stationary while the sleeve is moved up and down on the rod member. A lever-linkage is connected between the tab and a handle, and it is connected to the sleeve member so that lifting of the handle forces the sleeve member to slide downward around the rod member.

On the bottom of the sleeve member is a stop which is large enough that it will not go through the hole or opening in the water meter cover. Attached to the bottom of that stop is a downwardly extending spacer. The spacer is generally wedge-shaped and is sufficiently narrow that it will fit into the opening in the water meter cover adjacent the downwardly extending rod member. The wedge is positioned radially opposite the hook direction so that when the wedge is pushed downward into the opening in the water meter cover, the hook is pushed under the bottom edge of the water meter cover to engage the cover.

The handle and lever means are positioned such that when the handle is in a downward position the sleeve member and the stop and wedge on its bottom edge are lifted to allow the rod member with its hook to be freely moved upward and downward within the opening in the water meter cover. When the handle is lifted, the stop and wedge are forced downward relative to the rod and in operation the wedge is forced into the opening in the water meter cover.

An optional spring may be positioned between the rod and sleeve to bias the sleeve member upward relative to the rod member.

It is therefore and object of this invention to lift other objects.

It is a more specific object of this invention to lift water meter box covers.

It is still a more specific object of this invention to provide apparatus for lifting water meter covers.

It is yet a more specific object of this invention to provide apparatus for lifting water meter covers having an opening therein wherein a rod having a hook on the bottom end is enclosed with a sleeve having a wedge on the bottom end, the wedge being radially positioned opposite the hook, a stop on the bottom end of the sleeve, spring bias means between the rod and the sleeve for biasing the sleeve upwards relative to the hook, and a lever system for forcing the sleeve downward against the biasing means.

It is a broader object of this invention to provide opposable hook and stop means between which a water meter cover may be sandwiched to grasp the cover for removal.

BRIEF DESCRIPTION OF THE DRAWINGS

Other objects will become apparent from the following description, taken in conjunction with the accompanying drawings, in which:

FIG. 1 is a profile view of a preferred embodiment of the invention showing its insertion into an opening in a water meter cover and in its sleeve-upward position;

FIG. 2 is a view, partly in profile and partly in section, of the apparatus of FIG. 1 fully engaging a water meter cover and in its sleeve-downward position;

FIG. 3 is a view taken at 3—3 in FIG. 1;

FIG. 4 is a view, partly in section, taken at 4—4 in FIG. 2; and

FIG. 5 is a view, partly in section, taken at 5—5 in FIG. 2.

DETAILED DESCRIPTION OF THE INVENTION

The apparatus of this invention is a device for easily lifting such items as the cover or lid 14 of a water meter box. Typically such lids are on the order of two feet by one foot by two inches thick and are fabricated of concrete. Also typically the lid 14 has an opening 44 therein for grasping the lid to remove it.

The apparatus comprises a generally upstanding rod member 12 surrounded by a sleeve member 10. On the bottom end of the rod member 12 is a hook 38 which is usually a right angle bend of the rod, and the hook is small enough that it may be inserted into and through the hole 44 as shown in FIG. 1. The bottom end of the sleeve member 10 has a stop 40 which may, typically, be a circular disc. Depending from the stop 40 is a wedge member 42 which is radially positioned opposite the direction of the hook 38 as shown in FIGS. 1 and 2. The wedge member is small enough to be inserted into the hole 44 adjacent the shank of the rod member 12 as shown in FIG. 2, and it preferably is not tightly engaging the wall of the hole 44. The wedge member when inserted into the hole 44 pushes the hook 38 into engagement with the bottom of the lid 14 of the water meter box as shown in FIG. 2. To keep the wedge member 42 radially opposite the hook member 38 while still allowing the sleeve member 10 to slide up and down on the rod member 12, a slot 17 is formed or cut in the sleeve member 10 extending partly along the length thereof and sized to allow a tab 16 freely to slide therein. The tab 16 is attached to the rod member 12.

The tab member 16 also serves the purpose of delivering force to the rod member 12, and it is part of a lever system for forcing the sleeve member 10 into its downward position. A handle 20 is connected to a lever 18 which is pinned by a pin 22 to the sleeve 10. A tab 24 depends from the lever 18, and a linkage 26 is pinned by pin 28 to the tab 24 and by pin 30 to the tab 16. The axes of rotation of the various linkages about the pins 22, 28 and 30 are parallel.

Spring 32 is positioned between members 10 and 12 and is preferably within the sleeve 10 as shown in FIG. 2.

When carried, the spring 32 biases the sleeve 10 upward relative to rod 12 as shown in FIG. 1. When it is desired to engage the apparatus with the cover 14 of a water meter compartment, the hook 38 is inserted into the hole 44 of the water meter cover as shown in FIG. 1. The operator preferably holds the apparatus by the handle 20, and the spring 32 is sufficiently strong to hold the weight of the sleeve in the position shown in FIG. 1. The apparatus is further pushed downward or merely allowed to descend into the hole 44, and the wedge 42 pushes the rod 12 to one side of the hole 44, in which position the hook 38 is beneath the bottom wall of the lid 14 but not necessarily engaging it. The operator then pulls upward on the handle 20 which pulls the hook 38 tight into engagement with the bottom wall of the lid 14 thereby firmly anchoring the rod 12. Further lifting of the handle 20 causes the linkage 18 to rotate about the fulcrum 28 to push the sleeve 10 downward against the bias of the spring 32 until the stop 40 is positioned against the upper wall of the lid 14 at which point the lid 14 is securely clamped between the hook 38 and the stop 40. Further lifting of the handle 20 lifts the lid 14 off of the water meter box.

When the lid 14 is replaced, the handle 20 is pushed or allowed to move downward about the fulcrum 28 which causes the sleeve 10 and stop 40 to rise into the position of FIG. 1, and the hook 38 and rod 12 may readily be removed through the hole 44.

Although it is preferred that the apparatus have a spring 32, it is not necessary. Without the spring 32, the handle would be moved downward into the position shown in FIG. 1 by holding the handle with one hand and the sleeve 10 with the other. The apparatus could then be inserted as described above and the handle 20 could be lifted to engage the hook 38 thence to move the sleeve 10 and the stop 40 into engagement with the lid 14. Further lifting of the handle 20 would lift the lid.

To disengage, one would need to hold the sleeve 10 while moving the handle 20 downward. The apparatus could then be lifted out of the hole 44.

In a broader sense, the invention comprises a pair of clamping members 38,40 with one of the clamping members 38 sized to go through the hole 44 and the other clamping member having a downwardly extending wedge member 42 for pushing the member 38 into its clamping position. The two members 38,40 are biases apart by spring means 32, and a lever system 16,30,26,28,24,18,22,20 is connected to the members 38,40 to actuate the members 38,40 into their clamping position to grasp or clamp the lid 14.

Although the invention has been described above, it is not intended that the invention should be limited to that description alone, but in combination with the accompanying claims.

We claim:

1. A device for lifting articles, which articles include a hole of fixed size extending through such article, said device comprising:

1. Rod means with offset means on one end thereof said offset means and rod means being of a size so as to be insertable through said article in said hole;
2. Tab means attached essentially perpendicularly to said rod at a distance from said offset means;
3. Elongated cylindrical means slideably mounted about said rod means, with said offset means extending outwardly from the first end of said cylindrical means, said cylindrical means having an elongated opening in its wall suitable to allow said tab means to project outwardly therethrough and of such length that said rod means with said tab means attached can slide within said cylindrical means;
4. Lever means pivotally attached to said cylindrical means at its second end;
5. Means cooperative with the said first end of said cylindrical means which means prevent said cylindrical means from entering the said hole in said article; and
6. Connecting means pivotally connecting said tab means to said lever means in such manner that the said rod means is forced into said cylindrical means so as to bring the said offset means closer to the said first end of said cylindrical means when the lever means is moved in one direction and so that said offset means is moved away from said first end of said cylindrical means when the said lever means is moved in the other direction.

2. The device of claim 1, wherein the said first end of said cylindrical means is equiped with a wedge means which partially enters the hole in said article in such manner as to force the offset means into a position where it cannot be removed from said article while said wedge means is in position.

3. A device for lifting articles which have a hole extending through the thickness of such article comprising:

1. An elongated member having handle means upon its first end and pivotal connecting means on its second end;
2. An elongated cylinder pivotally connected at its first end to the said pivotal connecting end attached to said handle;
3. Means attached to the second end of said elongated cylindrical means, which means are such size that said means cannot pass into the hole of the said article;
4. Wedge means attached to said means which will not pass into the hole, in such manner that said wedge means can pass into the said hole;
5. Rod means slideably mounted within said cylindrical means and extending a distance upon one end therefrom;
6. Hook means fastened to the rod means at its end extending from said cylindrical means, said hook means being of such size that it can pass through the hole in said article, but of such size that it cannot pass through the said hole when the said wedge means is in position within said hole;
7. Tab means attached to said rod means at a point within said cylinder means, and extending outwardly through said cylinder means in a slot formed in said cylinder means; and
8. Connecting means pivotally connected between said handle means and said tab means in such manner that when said handle means is moved in a direction away from the end of said rod having said hook means, the said hook means is moved toward the said cylinder means, and when said handle means is moved in the other direction the said hook means is forced outward and away from said cylinder means.

* * * * *